United States Patent [19]

Heinze et al.

[11] Patent Number: 4,755,222

[45] Date of Patent: Jul. 5, 1988

[54] SINTER ALLOYS BASED ON HIGH-SPEED STEEL

[75] Inventors: Barbara Heinze; Hans-Peter Koch, both of Stuttgart; Gundmar Leuze, Heimsheim; Hans Obenaus, Leonberg, all of Fed. Rep. of Germany

[73] Assignee: Robert Bosch GmbH, Stuttgart, Fed. Rep. of Germany

[21] Appl. No.: 30,870

[22] PCT Filed: Jun. 7, 1986

[86] PCT No.: PCT/DE86/00239

§ 371 Date: Feb. 17, 1987

§ 102(e) Date: Feb. 17, 1987

[87] PCT Pub. No.: WO87/00207

PCT Pub. Date: Jan. 15, 1987

[30] Foreign Application Priority Data

Jun. 29, 1985 [DE] Fed. Rep. of Germany ..... 3523398

[51] Int. Cl.[4] ..... C22C 23/00

[52] U.S. Cl. ..... 75/246; 75/243; 75/255; 419/38; 419/39; 419/58

[58] Field of Search ..... 75/255, 246, 243; 419/38, 39, 58

[56] References Cited

U.S. PATENT DOCUMENTS

| | | | |
|---|---|---|---|
| 2,352,316 | 6/1944 | Goetzel | 75/22 |
| 4,263,046 | 4/1981 | Fichte et al. | 75/241 |
| 4,519,839 | 5/1985 | Toyoaki et al. | 419/33 |
| 4,618,540 | 10/1986 | Holst et al. | 419/41 |

FOREIGN PATENT DOCUMENTS

| | | |
|---|---|---|
| 1298290 | 6/1969 | Fed. Rep. of Germany . |
| 2456781 | 7/1976 | Fed. Rep. of Germany . |
| 2708916 | 2/1977 | Fed. Rep. of Germany . |
| 968551 | 11/1950 | France . |
| 2292543 | 6/1976 | France . |

OTHER PUBLICATIONS

"Production of High-Speed Powders at SCM Metal Products", *MPR,* Apr. 1983, pp. 197–199.

Bruen et al., "Sintered High Speed Steels: Their Application and Uses", *MPR,* Sep. 1983, pp. 497–500.

Beiss, "PM Methods for the Production of High Speed Steels", *MPR,* Apr. 1983, pp. 185–194.

Dax, "PM High-Speed Steels by the CAP Process", *MPR,* Apr. 1983, pp. 200–202.

*Primary Examiner*—Stephen J. Lechert, Jr.

*Attorney, Agent, or Firm*—Frishauf, Holtz, Goodman & Woodward

[57] ABSTRACT

Sinter alloys based on high-speed steel are proposed, which can be used for producing wearing parts in machinery and vehicle contruction. The sinter alloys comprise a mixture of a powder of a high-speed steel and an unalloyed or a low-alloy iron powder. While the high-speed steel powder forms liquid phases upon sintering, the mixture components can be drawn from either the group of iron alloys that do not form liquid phases or the group of iron alloys that do form liquid phases. The proposed alloys cannot be sintered to the density of the high-speed steels, nor do they quite attain the strength values of such steels, but in the cases where these limit values for strength are not critical they have the decisive advantage that they can be sintered without deformation in standard protective gas furnaces lacking extreme temperature constancy and that they furthermore exhibit only very slight shrinkage. An example that has been demonstrated to be particularly valuable is the mixture of 65% by mass of the high-speed steel S 6.5.2 and 35% by mass of a phosphorus alloy iron powder having 0.45% P and 2% Si.

4 Claims, No Drawings

SINTER ALLOYS BASED ON HIGH-SPEED STEEL

STATE OF THE ART

The invention is directed to sinter alloys based on high-speed steel. Sintered high-speed steels are distinguished by great hardness, very good wear and satisfactory toughness. Powder metallurgical methods for producing articles from such steels assure a very high degree of material utilization and a low energy expenditure. Nevertheless, such steels have thus far been used substantially only in the field of heavy-duty cutting tools; as wearing parts in machinery and vehicle construction, they have not yet been able to gain acceptance because powder prices are high, sintering of the material is time-consuming, and special vacuum furnaces are required; also, the dimensional accuracy of the sintered parts is unsatisfactory, so that expensive finishing is usually necessary. In the aforementioned wearing parts in machinery and vehicle construction, exhaustion of the wear properties of the pure high-speed steels up to the limit is often less critical, while in this case the dimensional accuracy of the parts produced from the material is a weightier argument, as long as such sinter steels offer greater reliability than the normal case-hardened sintered steels.

ADVANTAGES OF THE INVENTION

The sinter alloys according to the invention have the advantage over the prior art that they can be sintered in standard furnaces in protective gases, without the shrinkage that occurs with pure high-speed steels. Deviations in temperature upon sintering in protective gas furnaces, from a command value, which with pure high-speed steel powders are well known to lead to major dispersion of dimensions, is practically insignificant with sintering in the protective gas furnace. These mixed materials, in contrast to pure high-speed steels, are intentionally optimized not for full density but rather for processability with the greatest possible dimensional accuracy. By means of a heat treatment corresponding to the high-speed steels, the properties of these combination steels can be improved analogously to what is done with the pure high-speed steels, without impairing their dimensional accuracy. A further advantage is that by replacing part of the high-speed steel powder with less-expensive iron powder, a savings up to 40% of the cost for powder can be realized. It has already been noted above that although these combination materials—if for no other reason because of the pores they exhibit—do not attain the hardness, wearing and bending strength values of pure high-speed steels, they do exceed the values for standard case-hardened steels. In fact the presence of the pores makes it advantageous to use the sinter steels according to the invention precisely where hard, wear-resistant surfaces having pores for receiving lubricants are needed.

By means of the provisions recited in the dependent claims, advantageous further features of and improvements to the sinter alloys disclosed in the main claim are possible. Sinter alloys comprising 65% by weight of a high-speed steel powder of the type S 6.5.2 having approximately 0.9% C, 6.3% W, 5.2% Mo, 4.2% Cr, 1.9% V and the remainder Fe and 35% by weight of a phosphorus alloy iron powder having 0.45% P, 1.5–2% Si and the remainder Fe are particularly advantageous, because they have particularly good hardness and wearing properties and furthermore can be sintered with high shape stability.

DESCRIPTION OF THE EXEMPLARY EMBODIMENTS

Among numerous possible mixture systems, mixtures of the high-speed steel powder type M2, corresponding to S 6.5.2 having 0.9% C, 6.3% W, 5.2% Mo, 4.2% Cr, 1.9% V and the remainder Fe (all the percentages given are by weight) with approximately 50% by weight of pure iron powder and 0.15% carbon powder or 50% of a diffusion alloy iron powder having 1.5% Cu, 4% Ni and 0.5% Mo and 0.2% carbon powder are distinguished by their low powder costs, favorable behavior during sintering and high hardness and wearing values. The low amounts of carbon added improve both behavior during sintering and the values of the properties. These materials can be produced with densities of approximately 7.0 g/cm$^3$.

In these mixtures, the component added to the high-speed steel powder does not, in contrast to the high-speed steel powder, form a liquid phase; here, it acts as a support framework, which counteracts the tendency to shrinkage on the part of the high-speed steel powder. Only when the content of the high-speed steel powder is over 50% does the liquid phase former begin to come into play, with the result that the material undergoes shrinkage.

For producing the molded articles, the components are mixed thoroughly and then compacted at pressures of 600 to 800 MN/m$^2$, and sintered in chamber furnaces in pure hydrogen or nitrogen-hydrogen gas mixtures at 1250° C. for one hour. The shrinkage during sintering is on the order of less than 0.2%. If the workpieces are quenched at a temperature of 1190° C. and tempered twice for 60 minutes at 550° C., hardnesses of between 500 and 575 HV3 are attained. The bending strength is on the order of 1500 to 1800 N/mm$^2$.

Contrarily, mixtures of high-speed steel powders with phosphorus-silicon alloy iron powder behave differently: Beginning at the value for the pure phosphorus-silicon alloy material, the density decreases with an increasing high-speed steel content to below the values for the unsintered material and does not begin to increase again until the high-speed steel content becomes relatively high. This behavior was initially unexpected, because both partners in the mixture are liquid phase formers and should therefore, even in mixtures, have exhibited an increase in density upon sintering. It was demonstrated, however, that these materials can be processed with only slight shrinkage, that is, can be processed practically true to dimensions. An example of such a mixture is a mixture comprising 65% of the above-mentioned high-speed steel powder and 35% of an iron-silicon-phosphorus powder material having 2% Si and 0.45% P, which was processed in the same manner as described above. Once again, the shrinkage upon sintering is less than 0.2%; the hardness HV3 after sintering is on the order of 550 to 600, and after the heat treatment is 650 to 750. The bending strength, at 850 to 900 N/mm$^2$, is lower than in the case of the mixtures described above. The above-mentioned iron-silicon-phosphorus alloy is described in further detail in German Pat. No. 27 08 916.

We claim:

1. Sinter alloys based on high-speed steel comprising a sintered mixture of (i) a powder of a high-speed steel and (ii) an unalloyed or low-alloy iron powder that does not form a liquid phase, said iron powder containing about 0.1% to about 0.5% carbon, with said high speed steel powder being present in said mixture in the amount of up to approximately 50% by weight, said sinter alloy in compacted form being characterized by high dimensional accuracy when sintered.

2. The sinter alloys according to claim 1 wherein the unalloyed or low-alloy iron powder comprises a pure iron powder or a diffusion alloy iron powder having 1.5% Cu, 4% Ni and 0.5% Mo.

3. The sinter alloys according to claim 1, comprising approximately 50% high speed steel.

4. The sinter alloys according to claim 2, comprising approximately 50% high speed steel.

* * * * *